United States Patent [19]

Goyarts

[11] 4,415,208

[45] Nov. 15, 1983

[54] CUTTER BIT ASSEMBLY

[75] Inventor: Wynand M. Goyarts, Washington, Pa.

[73] Assignee: Ingersoll-Rand Company, Woodcliff Lake, N.J.

[21] Appl. No.: 289,060

[22] Filed: Jul. 31, 1981

[51] Int. Cl.[3] ..... E21C 35/18

[52] U.S. Cl. ..... 299/91; 175/413; 299/86

[58] Field of Search ..... 299/86, 91–93; 175/413; 37/142 R, 142 A

[56] References Cited

U.S. PATENT DOCUMENTS

| | | | |
|---|---|---|---|
| 1,468,866 | 9/1923 | Morgan | 299/92 X |
| 3,404,501 | 10/1968 | Von Wedel | 52/127 X |
| 3,989,115 | 11/1976 | Ambrose | 175/384 |
| 4,057,294 | 11/1977 | Krekeler | 299/93 |
| 4,240,669 | 12/1980 | Rollins | 299/86 |

*Primary Examiner*—Ernest R. Purser

*Attorney, Agent, or Firm*—R. J. Palkowski

[57] ABSTRACT

A cutter bit assembly having an elongated cutter bit, a bit holder, a bit block and a locking means for removably affixing the bit holder to the bit block. The bit holder has a tapered locking lip and a tapered surface wherein a resultant cutting force provides a locking action between the tapers.

12 Claims, 5 Drawing Figures

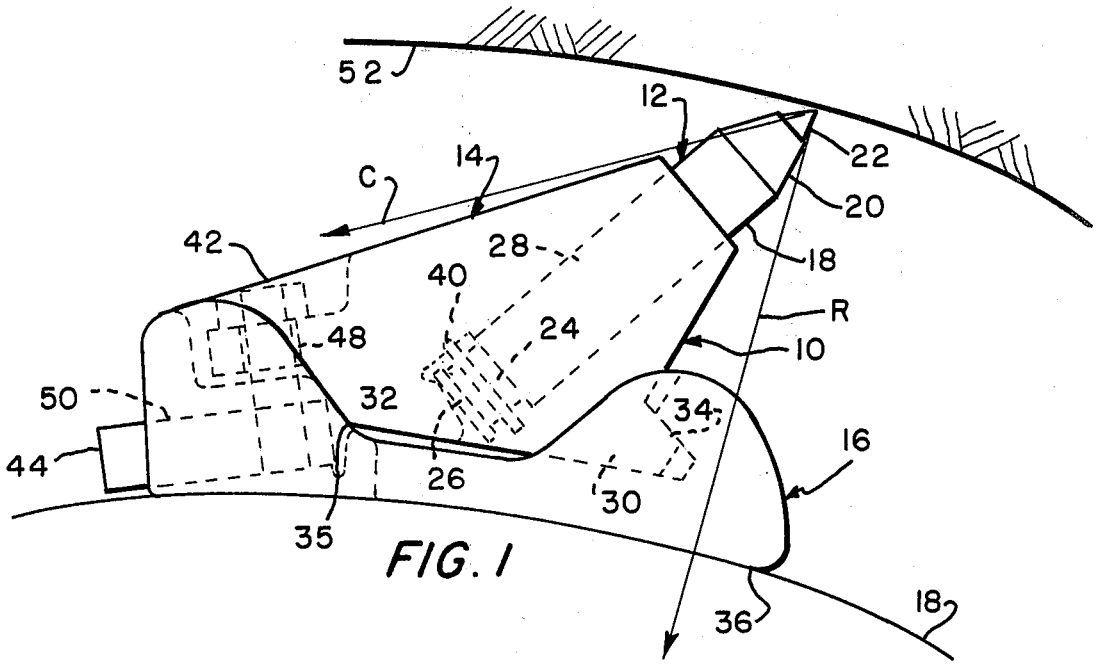
FIG. 1
FIG. 3
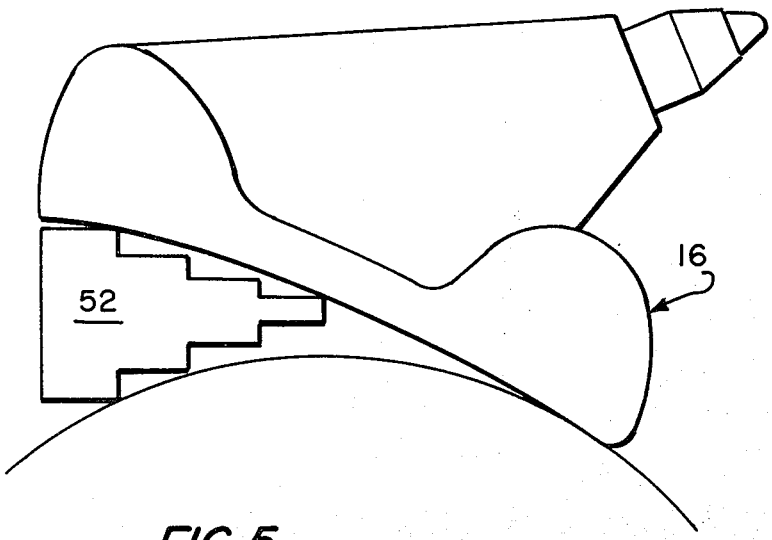
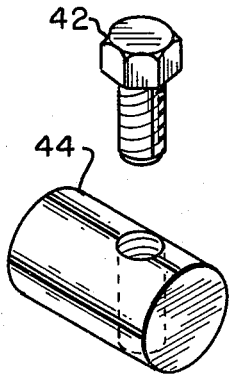
FIG. 2
FIG. 4
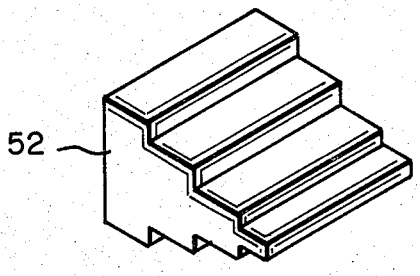
FIG. 5
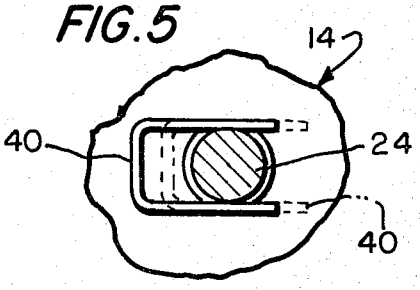

CUTTER BIT ASSEMBLY

CROSS-REFERENCE TO RELATED APPLICATIONS

This application relates to co-pending applications "A Cutter Bit Assembly" Ser. No. 176,986, filed Aug. 11, 1980 by Michael L. Aden, and to co-pending application "A Cutter Bit Assembly with a Conical Bit Holder" Ser. No. 176,987, filed Aug. 11, 1980 by W. M. Goyarts which applications are herein incorporated by reference.

BACKGROUND OF THE INVENTION

1. Field of the Invention

This invention pertains to a cutter bit assembly and more particularly to a bit holder having a tapered locking lip and a tapered surface. A bit block has an engaging section for contacting the tapered lock lip and an engaging surface for contacting the tapered surface. A resultant cutting force provides a locking action between the tapers.

2. Description of the Prior Art

In mining, digging and earth working operations, cutting elements are attached to drive elements of mining, digging and earth working apparatus and are subject to wear and breakage requiring replacement. Efforts have been directed to developing cutter assemblies affording readily replaceable cutting elements. The replaceable cutting elements are desired to be versatile, compact, economical and securely locked into place during cutting.

SUMMARY OF THE INVENTION

This invention relates to a cutter bit assembly having an elongated cutter bit and a bit holder. The bit holder has a tapered locking lip and a tapered surface. A bit block is provided which has an engaging section for contacting the tapered locking lip and an engaging surface for contacting the tapered surface wherein a resultant cutting force provides a locking action between the tapers. Also provided are a first locking means for removably affixing the elongated cutter bit to the bit holder, and a second locking means for removably affixing the bit holder to the bit block.

BRIEF DESCRIPTION OF THE DRAWINGS

FIG. 1 is a cross-sectional view of a cutter bit assembly.

FIG. 2 is a view of a circular nut and bolt.

FIG. 3 is a side view of a cutter bit assembly wherein the attack angle has been altered by a wedge.

FIG. 4 is a view of a wedge.

FIG. 5 is a view of a retaining U-clip.

DESCRIPTION OF THE PREFERRED EMBODIMENT

Referring to FIG. 1, a cutter bit assembly 10 is shown. The cutter bit assembly comprises an elongated cutter bit 12, a bit holder 14, and a bit block 16. Elongated cutter bit 12 includes conventional cutter bits such as those having an elongated shank 18, with a conical nose 20 at one end terminating in a hard tip 22. At the other end of shank 18 is an annular notch 24 and an abutment 26. Shank 18 has a circular crosssection.

Bit holder 14 has an elongated opening 28 for receiving the elongated cutter bit 12. Elongated opening 28 includes conventional openings such as cylindrical openings. Bit holder 14 further has a tapered locking lip 30 and a tapered surface 32. Tapered surface 32 includes conventional surfaces such as flat surfaces and curved surfaces.

Bit block 16 has an engaging section 34 for contacting tapered locking lip 30 and has an engaging surface 35 for contacting tapered surface 32 of bit holder 14. Bit block 16 further has a surface 36 for contacting a drive element 38 of a mining, digging or earth working machine. Drive element 38 includes conventional drive elements such as rotating drums and chain links. Bit block 16 is permanently or semipermanently attached to drive element 38 by conventional means such as welding and bolting.

Elongated cutter bit 12 is removably fixed to bit holder 14 by a first locking means. First locking means includes conventional means such as retaining U-clip 40, pins and clips. Bit holder 14 is removably affixed to bit block 16 by a second locking means. Second locking means includes conventional means such as a male bolt 42 and a cylindrical nut 44 as shown in FIGS. 1 and 2. The second locking means is positioned in the rearward section of cutter bit assembly 10. When male bolt 42 and cylindrical nut 44 are employed, bit holder 16 contains a bolt opening 48 and bit block 16 contains a nut opening 50.

As the drive element 38 rotates, tip 22 of the elongated cutter bit 12 contacts the surface of the mine or earth 52 thereby dislodging material. A resultant force C on elongated cutter bit 12 is created. The force exerted on elongated cutter bit 12 is transferred to bit holder 14 primarily by means of the abutment 26. Elongated opening 28 preferably extends most of the length of shank 18 providing support to elongated cutter bit 12. The diameter of the elongated opening 28 should approximate the diameter of shank 18, but preferably, should be large enough to allow shank 18 to rotate. The force exerted on the bit holder 14 is transferred to bit block 16 by means of tapered surface 32 contacting engaging surface 35 and tapered locking lip 30 contacting engaging section 34. The tapering provides a locking action of bit holder 14 to bit block 16.

In order to remove the elongated cutter bit 12, bit holder 14 may first be removed from the bit block 16. This is accomplished by releasing the second locking means. As shown in FIG. 1 bolt 42 and circular nut 44 are removed and bit holder 14 is tapped out of bit block 16. Elongated cutter bit 12 can then be removed from the bit holder 14 by removing first locking means 40. Elongated cutter bit 12 is then removed from bit holder 14 and replaced by a new one. First locking means 40 removably affixes new elongated cutter bit 12 to the bit holder 14. Bit holder 14 is then reinserted into bit block 16 wherein the bit holder 14 is removably affixed to the bit block 16 by the second locking means. Elongated cutter bit 12 may also be replaced without removing bit holder 14 from bit block 16. In this embodiment first locking means 40 is inserted from the side as shown in FIG. 5. The compact design of the present invention allows for the distance between hard tip 22 and drive element 30 along the radian R shown in FIG. 1 to be the same for non-removable weld on cutter units currently in use.

The tilt and skew of the angle of attack may be modified by changing the alignment of elongated opening 28 in bit holder 14. Modifying tilt will either increase or decrease the angle of attack. Changing skew will point the angle of attack to either the right or left of the direction of rotation. Skew and tilt may also be changed by modifying surface 36 of bit block 16 or a wedge may be employed to vary the angle bit block 16 is welded onto drive element 38. The use of wedge allows for one bit block configuration to cover a complete range of drive element designs since the wedge will change the attack angle. The wedge includes conventional wedges such as triangular, block and stepped shaped wedge 52 as shown in FIGS. 3 and 4. When a stepped shaped wedge is employed, the smaller steps are used for drive elements having larger drum diameters and the larger steps are used with smaller drum diameters. Beyond a predetermined maximum diameter a wedge is not necessary.

I claim:

1. A cutter bit assembly adapted to be mounted on a drum for cutting with rotation in a selected direction comprising:

(a) an elongated cutter bit;

(b) a bit holder having a tapered locking lip positioned at the end of the bit holder toward the direction of rotation of the cutter bit assembly and a tapered surface positioned near the end opposite to the direction of rotation and tapered in a selected direction;

(c) a first locking means for removably affixing the elongated cutter bit to the bit holder;

(d) a bit block having an engaging section for contacting the tapered locking lip and an engaging surface for contacting the tapered surface at a selected angle whereby the force applied to the bit block during operation forces the engaging surface and the tapered surface to provide a locking action between the tapers; and (e) a second locking means for removably affixing the bit holder to the bit block.

2. A cutter bit assembly according to claim 1 wherein the elongated cutter bit further comprises a shank, a conical nose, a hard-tip, an annular notch, and an abutment.

3. A cutter bit assembly according to claim 2 wherein the shank of the elongated cutter bit is cylindrical in shape.

4. A cutter bit assembly according to claim 1 wherein the elongated opening in the bit holder is a cylindrical opening.

5. A cutter bit assembly according to claim 1 wherein the elongated cutter bit is permitted to rotate in the elongated opening.

6. A cutter bit assembly according to claim 1 wherein the first locking means is a retaining U-clip.

7. A cutter bit assembly according to claim 1 wherein the bit block further comprises a surface curving to the curvature of a drive drum.

8. A cutter bit assembly according to claim 1 wherein the second locking means is positioned in the rearward section of the cutter bit assembly.

9. A cutter bit assembly according to claim 1 wherein the cutter bit assembly further comprises a wedge attached to the curved surface of the bit block.

10. A cutter bit assembly according to claim 9 wherein the wedge is step-shaped.

11. A cutter bit assembly comprising:

(a) an elongated cutter bit;

(b) a bit holder having a tapered locking lip located on the bit holder towards a selected end of the cutter bit assembly, a tapered surface positioned at an end opposite the tapered locking lip and having a slope in a selected direction, a bolt opening and an elongated opening for receiving the elongated cutter bit;

(c) a first locking means for removably affixing the elongated cutter bit to the bit holder;

(d) a bit block having a nut opening and an engaging surface substantially parallel to the tapered surface for contacting the tapered locking lip and an engaging surface for contacting the tapered surface;

(e) a bolt positioned in the bolt opening; and (f) a cylindrical nut positioned in the nut opening and threaded to the bolt wherein the bit holder is locked to the bit block.

12. A cutter bit assembly according to claim 11 wherein the bolt and cylindrical nut are positioned in the rearward section of the cutter bit assembly.

* * * * *